US008261779B2

(12) United States Patent
Horiguchi et al.

(10) Patent No.: US 8,261,779 B2
(45) Date of Patent: Sep. 11, 2012

(54) BASE CLOTH FOR AIR BAG, RAW YARN FOR AIR BAG, AND METHOD FOR PRODUCING THE RAW YARN

(75) Inventors: Hirotaka Horiguchi, Okazaki (JP); Hiroaki Ozawa, Mishima (JP); Daisuke Yokoi, Otsu (JP)

(73) Assignee: Toray Industries, Inc. (JP)

( * ) Notice: Subject to any disclaimer, the term of this patent is extended or adjusted under 35 U.S.C. 154(b) by 156 days.

(21) Appl. No.: 12/920,945

(22) PCT Filed: Jan. 20, 2009

(86) PCT No.: PCT/JP2009/050713

§ 371 (c)(1), (2), (4) Date: Oct. 7, 2010

(87) PCT Pub. No.: WO2009/113325

PCT Pub. Date: Sep. 17, 2009

(65) Prior Publication Data

US 2011/0036447 A1 Feb. 17, 2011

(30) Foreign Application Priority Data

Mar. 10, 2008 (JP) ..... 2008-059831

(51) Int. Cl.

| | |
|---|---|
| ***D03D 3/02*** | (2006.01) |
| ***D03D 1/04*** | (2006.01) |
| *D03D 13/00* | (2006.01) |
| *D03D 25/00* | (2006.01) |

(52) U.S. Cl. ..... 139/387 R; 139/389; 139/384 R; 139/383 R

(58) Field of Classification Search ..... None
See application file for complete search history.

(56) References Cited

U.S. PATENT DOCUMENTS

| | | | | | |
|---|---|---|---|---|---|
| 3,991,249 | A | * | 11/1976 | Yamashita et al. | 428/35.5 |
| 5,637,385 | A | * | 6/1997 | Mizuki et al. | 442/361 |
| 5,989,660 | A | * | 11/1999 | Moriwaki et al. | 428/35.2 |
| 6,135,161 | A | * | 10/2000 | Nakano et al. | 139/55.1 |
| 6,291,040 | B1 | * | 9/2001 | Moriwaki et al. | 428/35.2 |
| 7,687,413 | B2 | * | 3/2010 | Schmitt | 442/154 |
| 2002/0155774 | A1 | * | 10/2002 | Kitamura et al. | 442/208 |
| 2003/0008582 | A1 | * | 1/2003 | Koketsu et al. | 442/195 |
| 2006/0040577 | A1 | * | 2/2006 | Schmitt | 442/154 |
| 2006/0183390 | A1 | * | 8/2006 | Fukunishi et al. | 442/181 |
| 2008/0188151 | A1 | * | 8/2008 | Yokoi et al. | 442/76 |
| 2009/0029617 | A1 | * | 1/2009 | Akimori et al. | 442/208 |
| 2009/0314378 | A1 | * | 12/2009 | Huber et al. | 139/389 |
| 2010/0048079 | A1 | * | 2/2010 | Fujiyama et al. | 442/189 |
| 2010/0260976 | A1 | * | 10/2010 | Kano et al. | 428/172 |
| 2010/0282358 | A1 | * | 11/2010 | Kano et al. | 139/384 R |
| 2011/0097955 | A1 | * | 4/2011 | Kano et al. | 442/76 |
| 2012/0043742 | A1 | * | 2/2012 | Kim et al. | 280/730.2 |

FOREIGN PATENT DOCUMENTS

| | | | | |
|---|---|---|---|---|
| JP | 6-306728 | A | | 11/1994 |
| JP | 2002069790 | A | * | 3/2002 |
| JP | 2002138339 | A | * | 5/2002 |
| JP | 2002-266161 | A | | 9/2002 |
| JP | 2003293241 | A | * | 10/2003 |
| JP | 2006-016707 | A | | 1/2006 |
| JP | 2007-247118 | A | | 9/2007 |
| JP | 2008-025089 | A | | 2/2008 |
| JP | 2008025089 | A | * | 2/2008 |
| JP | 2008025090 | A | * | 2/2008 |
| JP | 2009209497 | A | * | 9/2009 |
| JP | 2009235593 | A | * | 10/2009 |
| JP | 2009243030 | A | * | 10/2009 |
| JP | 2010100988 | A | * | 5/2010 |
| WO | 99/22967 | A1 | | 5/1999 |
| WO | 01/09416 | A1 | | 2/2001 |

* cited by examiner

*Primary Examiner* — Bobby Muromoto, Jr.

(74) *Attorney, Agent, or Firm* — DLA Piper LLP (US)

(57) ABSTRACT

An air bag fabric includes a warp and a weft, each including polyamide multifilaments with a total fineness of 200 to 700 dtex and a single fiber fineness of 1 to 2 dtex and having a cover factor (CF) of 1,800 to 2,300, wherein a ratio ECw/Mtw between edgecomb resistance, EDw, and single fiber fineness, Mtw, in the warp direction, and a ratio ECf/Mtf between edgecomb resistance, ECf, and single fiber fineness, Mtf, in the weft direction are both in a range of 250 to 1,000 N/dtex.

15 Claims, No Drawings

BASE CLOTH FOR AIR BAG, RAW YARN FOR AIR BAG, AND METHOD FOR PRODUCING THE RAW YARN

RELATED APPLICATIONS

This is a §371 of International Application No. PCT/JP2009/050713, with an international filing date of Jan. 20, 2009 (WO 2009/113325 A1, published Sep. 17, 2009), which is based on Japanese Patent Application No. 2008-059831, filed Mar. 10, 2008, the subject matter of which is incorporated by reference.

TECHNICAL FIELD

This disclosure relates to a fabric for manufacturing air bags, a yarn for manufacturing an air bag fabric, and a method for producing the yarn. Specifically, it relates to an air bag fabric that has low air permeability and high edgecomb resistance and serves to produce high-foldability air bags that can be packed into small volumes, and also relates to a yarn for manufacturing air bags, and a method for producing the yarn.

BACKGROUND

As people think of traffic safety more seriously in recent years, various air bags have been developed to ensure the safety of the driver and passengers in case of an automobile accident, and practical products have been spreading rapidly as their effectiveness is known more widely.

Air bags expand and unfold in a very short time following a vehicle collision to receive the driver and passengers who move in reaction to the collision and absorb the impact to protect them. To act effectively, fabrics used as material for the bags have to be low in air permeation. They must also have a certain level of strength to resist the impact caused by expansion of air bags. To allow the internal pressure in the air bags to be maintained above a certain level when the bags expand and receive the driver and passengers, it is necessary to minimize the seam slippage, or improve the seam slippage resistance, in the sewed portions. In addition, they are required to be packed in small volumes for purposes of interior design and arrangement of various components including the bags, and cost reduction is currently called for more strongly.

Conventionally, various fabrics have been proposed as material to produce air bags with such improved characteristics necessary for them.

For instance, a super-high-density air bag fabric has been disclosed as air bag fabric material with high seam slippage resistance in sewed portions (for instance, see JP 2006-16707).

In this proposal, a high density fabric with a cover factor in the range of 2,300 to 2,600 is used to improve the mechanical characteristics and edgecomb resistance of fabrics, and it has an air permeability that is sufficiently high as non-coated base fabric. However, it does not have a sufficiently high foldability and, therefore, fails to simultaneously have high edgecomb resistance, low air permeability and high foldability.

On the other hand, as a means of producing a lightweight, compact air bag, it has been proposed to use an air bag fabric produced from fibers that are dramatically thin compared to common industrial fibers. For instance, an air bag fabric produced from yarns with a single fiber fineness of 1.0 to 3.3 dtex and a total fiber fineness of 66 to 167 dtex having a specific relation between the total fineness and the fabric density has been disclosed (for instance, see WO 99/22967).

The fabric proposed in WO 99/22967, however, has a problem in terms of tear strength and the like, and an air bag fabric carrying a lubricant up to 0.8 wt % or more on its surface has been disclosed as a means of solving the problem (for instance, see WO 01/009416).

Although this means can reduce the foldability of bags, the fabric carries a large amount of a lubricant to decrease the edgecomb resistance, failing to achieve a satisfactory seam slippage resistance. Furthermore, the resulting fabric has an air permeability of 0.2 $cm^3/cm^2/sec$ according to JIS L-1096 8.27.1A but cannot give satisfactory results in the high pressure test at 19.6 kPa commonly practiced in recent years, failing to ensure a high unfoldability as required these days. For the air bag fabrics composed of thin fibers as proposed in WO 99/22967 and WO 01/009416, furthermore, it is necessary to use yarns with increased strength to produce high-strength fabric in consideration of the decrease in the strength of the yarns resulting from the decrease in fineness. In such a low fineness range, however, there are no techniques available even for producing high strength fibers equivalent to the conventional industrial fibers, while the thin-fiber fabrics for air bags disclosed in the past are inferior in mechanical characteristics.

In addition, as a means of producing an air bag fabric with a good balance among low air permeability, high strength, high foldability, and high seam slippage resistance, an air bag fabric has been disclosed that is composed of a warp and a weft made of the same synthetic fibers in which the ratio between the weft's fabric density and the warp's fabric density is 1.10 or more (see JP 2008-25089).

It is true that this proposal makes it possible to produce a good balanced air bag fabric, but improvement in air permeability, edgecomb resistance, and mechanical characteristics cannot be achieved simultaneously with improvement in foldability, failing to provide an air bag fabric excellent in all these characteristics.

Thus, prior art has not been successful in providing an air bag fabric that has necessary characteristics including low air permeability, high strength, high foldability, and high seam slippage resistance.

It could therefore be helpful to provide an air bag fabric and an air bag that have low air permeability and mechanical characteristics required in an air bag fabric, high seam slippage resistance with little shift in seam in air bags' sewed portions caused when receiving the driver and passengers after expansion and unfolding, and high air bag foldability, which has been impossible to improve simultaneously with the aforementioned characteristics.

SUMMARY

We provide an air bag fabric comprising a warp and a weft both of polyamide multifilaments with a total fineness of 200 to 700 dtex and a single fiber fineness of 1 to 2 dtex and having a cover factor (CF) of 1,800 to 2,300 wherein the ratio ECw/Mtw between the edgecomb resistance, ECw, and the single fiber fineness, Mtw, in the warp direction, and the ratio ECf/Mtf between the edgecomb resistance, ECf, and the single fiber fineness, Mtf, in the weft direction are both in the range of 250 to 1,000 N/dtex.

It is preferable that in the air bag fabric:

- the edgecomb resistance is in the range of 500 to 1,000 N in both the warp direction and the weft direction of the fabric,
- the air permeation as measured at a test pressure difference of 19.6 kPa is 0.5 $L/cm^2/min$ or less, the product AP×CF of the air permeation AP (L/cm$^2$/min) multiplied by the cover factor CF is 1,100 L/cm$^2$/min or less, the cover factor CFw of the warp in the fabric smaller by 50 to 200 than the cover factor CFf of the weft, and the packability is 1,500 or less.

It is preferable that the yarn that constitutes the air bag fabric:

comprises polyamide multifilaments having a total fineness of 200 to 700 dtex, a single fiber fineness of 1 to 2 dtex, a strength of 7 to 10 cN/dtex, and an elongation of 20 to 30%;

comprises a polyamide with a sulfuric acid relative viscosity of 3 to 4 wherein the polyamide is polyhexamethylene adipamide; and has a fineness unevenness of 0.5 to 1.5%, and it is preferable that the produce method comprises:

melt-spinning polyamide, cooling in a circular cooling equipment and stretching;

giving steam to the fiber coming from the melt spinning machine through and spinning orifices, and allowing the fiber to pass through a slow cooling cylinder;

wherein the slow cooling cylinder has a length of 30 to 150 mm, and the circular cooling equipment has a cooling air blown-out distance is 600 to 1,200 mm;

the circular cooling equipment is used to provide cooling air after compressing so that the difference between the cooling cylinder pressure and the atmospheric pressure is 500 to 1,200 Pa;

the circular cooling equipment used provides cooling air with its air speed not uniform along the length direction of the equipment, the upper side air speed $V_U$ being smaller than the lower side air speed $V_L$, and the values of $V_L/V_U$, $V_U$, and $V_L$ being 2 to 3, 10 to 30 m/min, and 40 to 80 m/min, respectively; and the steam blow pressure is 100 to 600 Pa. Excellent effect is expected if these requirements are met.

As described below, we thus provide a compact air bag that has low air permeability, high strength, and high seam slippage resistance. It also provides a high-quality, low-priced process to produce a yarn and fabric suitable for manufacturing the air bag.

DETAILED DESCRIPTION

It is necessary that the fibers that constitute the air bag fabric have a total fineness of 200 to 700 dtex. If the total fineness is less than 200 dtex, the tear strength and combustibility of the fabric decreases as described above. This can be avoided if a large amount of a lubricant is adhered over the fabric, but this largely decreases the edgecomb resistance of the fabric. Furthermore, as it is difficult to produce high strength fibers stably, the quality of the fabric will deteriorate and the productivity will decrease for both the yarn and fabric. If the total fineness is above 700 dtex, on the other hand, the number of single yarns will be too large to obtain a polyamide multifilament with a single fiber fineness of 1 to 2 dtex, and it will be extremely difficult for the conventional techniques to carry out spinning, making it necessary to use fiber yarns produced by doubling of 2 to 3 yarns. This decreases the productivity and satisfactory foldability and air permeation will not be achieved. The total fineness should preferably be in the range of 230 to 500 dtex, more preferably 250 to 400 dtex, and still more preferably 280 to 370 dtex. A total fineness maintained in this range can serve for balanced improvement of the strength, edgecomb resistance, air permeability, flexibility, and foldability.

It is necessary that the single fiber fineness is 1 to 2 dtex, preferably 1.1 to 1.9 dtex, and more preferably 1.2 to 1.8 dtex. For fiber materials for air bags, studies have long been focused on reduction in both the total fineness and single fiber fineness, but there have been no proposals that disclose a polyamide fiber simultaneously having a total fineness in the range of 200 to 700 dtex and a single fiber fineness less than 2 dtex, as proposed in this disclosure. Naturally, there have been no proposals that disclose characteristics required for air bag fabrics produced from such a polyamide fiber. This is because in the past attempts, the characteristics of fabrics do not improve any more as the single fiber fineness is decreased to about 3 to 4 dtex, and in addition, it is very difficult to perform spinning and stretching for stable direct produce industrial polyamide fibers that are composed of 100 or more monofilaments and have a single fiber fineness of 2 dtex or less. We developed a method based on the process described later to produce a polyamide fiber composed of 100 or more monofilaments and having a single fiber fineness of 2 dtex or less, and investigation on the characteristics of air bag fabrics constituted of the polyamide fiber. As a result, it was found that when a fabric is produced with the same method using a polyamide fiber only with a different single fiber fineness, the air permeation, foldability, and edgecomb resistance were all improved by maintaining the single fiber fineness at 2 dtex or less. In particular, maintaining the single fiber finenesss at 1.8 dtex or less was found to serve to improve the edgecomb resistance and air permeability to a higher degree than estimated from results of past studies. It should be noted, however, that it is still difficult to produce a polyamide fiber having a single fiber fineness of less than 1 dtex and suitable as material for air bags even by using our method.

It is also necessary for the warp and weft constituting the air bag fabric to be produced from polyamide. The use of a polyamide-based fiber serves to improve the flexibility, making it possible to produce a fabric with high foldability. The use of a polyester-based fiber will fail to produce fuzzing-free, high-strength fiber that is suitable for high speed weaving practiced these days, and the resulting air bag fabrics will be inferior in heat resistance and the like. The sulfuric acid relative viscosity should preferably be 3 to 4, more preferably 3.3 to 3.8, produce a high strength polyamide fiber that is suitable as material for air bags. The polyamide fiber may be any polyamide polymer selected from the group of polycaproamide (nylon 6), polyhexamethylene adipamide (nylon 66), and polytetramethylene adipamide (nylon 46), but polyhexamethylene adipamide is preferable because of its high impact resistance and heat resistance. Such a polyamide may be a copolymer containing a copolymerization component up to 5 wt % or less. The copolymerization components that can be used include ϵ-caproamide, tetramethylene adipamide, hexamethylene sebacamide, hexamethylene isophthalamide, tetra-methylene terephthalamide, and xylylene phthalamide. Polyamide chips with a high viscosity produced by solid phase polymerization may contain additives, such as weathering stabilizer, heat resistant agent, and antioxidant, as needed before being subjected to melt-spinning These additives may be added partly or totally during the polymerization process or mixed with other methods. The polyamide chips may also contain diamine, monocarboxylic acid or the like for adjustment of the amino-terminal content, and such adjustment may be performed appropriately to achieve a required amino-terminal content.

The air bag fabric should preferably have a edgecomb resistance of 500 to 1,000 N, more preferably 550 to 900 N, in both the warp direction and the weft direction. When it is 500 N or more, the air permeability is small, and the seam slippage resistance is high, or the shift of seams in sewed portions is small, during the expansion and unfolding of the air bag. It is preferable also because the fabric can have a sufficient ability to hold a required internal pressure in the air bag. When it is 1,000 N or less, on the other hand, it is not necessary to weave a fabric with a high gray fabric density, and foldability will not deteriorate, which is preferable. The ratio between the edgecomb resistance in the warp direction and that in the weft direction should preferably be 1 to 15%, more preferably 1 to 10%, to ensure uniform expansion of the air bag. The ratios ECw/Mtw and ECf/Mtf of the edgecomb resistance in the warp direction, ECw, and that in the weft direction, ECf, to the single fiber fineness in the warp direction, Mtw, and that in the weft direction, Mtf, respectively, should both be 250 to 1,000 N/dtex, preferably 280 to 950 N/dtex, and more preferably 300 to 900 N/dtex. If the ratio between the edgecomb resistance and the single fiber fineness is in this range, it will be possible to produce an air bag fabric with balanced properties in terms of seam slippage resistance, air permeability, foldability, mechanical characteristics, and cost performance.

The fabric should have a cover factor (CF) of 1,800 to 2,300, preferably 2,000 to 2,300, and more preferably 2,100 to 2,200. If the cover factor is maintained in this range, the air permeation, mechanical characteristics, edgecomb resistance, and foldability can be improved in a balanced manner. The warp's cover factor CFw and the weft's cover factor CFf should preferably be 950 to 1,350, more preferably 950 to 1,250. It is preferable that CFw is smaller than CFf, or that the cover factor in the weft direction is increased to improve the edgecomb resistance in both the warp direction and the weft direction. If improve in uniformity of the fabric is desired, it is preferable that the warp and the weft are of the same synthetic fiber, and that the weft's gray fabric density and fabric density are increased. The difference between CFf and CFw should preferably be 50 to 200, more preferably 70 to 150.

The warp's cover factor (CFw) and the weft's cover factor (CFf) in the fabric are calculated from the total fineness and the fabric density of yarns used as the warp and the weft, and they are expressed by the following equations where Dw (dtex) and Df (dtex) denote the total fineness of the warp and the weft, respectively, and Nw (number of yarns/2.54 cm) and Nf (number of yarns/2.54 cm) represent the fabric density of the warp and the weft, i.e., their number per 2.54 cm, respectively. The value of CF is the sum of CFw and CFf.

$$CFw=(Dw\times 0.9)^{1/2}\times Nw$$

$$CFf=(Df\times 0.9)^{1/2}\times Nf$$

In the air bag fabric, the features are coordinated synergically to ensure overall improvement of the high slippage, air permeability, and foldability as required for air bags.

The air bag fabric should preferably have an air permeation (AP) of 0.5 L/cm$^2$·min or less, more preferably 0.2 to 0.4 L/cm$^2$·min, and still more preferably 0.2 to 0.3 L/cm$^2$·min as measured by the Frajour testing method at a test pressure difference of 19.6 kPa. If the air permeation is adjusted to the aforementioned range, the gas for expanding the bag which comes from the inflator will be used efficiently without leakage at the time of a collision, making it possible to improve the unfolding ability of the air bag and receive the driver and passengers safely. If the air permeation (AP) exceeds 0.5 L/cm$^2$·min, the air bag will not be able to maintain the expanded state when the passenger hits it, leading to an inferior passenger holding ability, which is not preferable. In this air permeation range, the product AP×CF of the air permeation AP (L/cm$^2$/min) and the cover factor CF of the fabric should preferably be 1,100 L/cm$^2$/min or less, more preferably 1,000 L/cm$^2$/min or less, and still more preferably 900 L/cm$^2$/min or less. In general, the air permeation AP decreases with an increasing cover factor CF, but we found that with respect to the air bag fabric having a single fiber fineness of 1 to 2 dtex, the air permeation can be decreased even if the cover factor is small. It can be said, therefore, that an air bag fabric that has both a low air permeability and a high foldability will have a product AP×CF of 1,100 L/cm$^2$/min or less.

Furthermore, the air bag fabric should preferably have a packability of 1,500 or less, more preferably 1,000 to 1,400, and still more preferably 1,100 to 1,300, as measured according to ASTM D-6478-02. The labor effectiveness with respect to the workability for assembly of the air bag housing can be improved by adjusting the packability to the aforementioned range. In addition, the air bag for the driver seat, which is housed in the steering wheel component, can be reduced in unfolded bag size, making it possible to add various buttons, such as for navigation and gear shifting, to the steering wheel component to contribute to functional improvement of the automobile. If the packability exceeds 1,500, the workability for assembling will deteriorate to decrease the work efficiency, and for the air bag for the driver seat, in particular, it will be impossible to add various buttons, such as for navigation and gear shifting while incorporating the bag in the small space in the steering wheel component as described above, which is not preferable.

The polyamide multifilaments that constitute the air bag fabric should preferably have a strength of 7 to 10 c N/dtex, more preferably 8 to 9 c N/dtex, and still more preferably 8.3 to 8.7 c N/dtex to maintain the mechanical characteristics required for the air bag fabric and to ensure easy yarn-making operation. At the same time, the polyamide multifilaments should preferably have an elongation of 20 to 30%, more preferably 20 to 25%, and still more preferably 21 to 24% to increase the toughness and rupture work load of the air bag fabric and to ensure high yarn-making performance and high weaving performance.

Furthermore, the polyamide multifilament should preferably have a fineness unevenness of 0.5 to 1.5%, more preferably 0.5 to 1.0%, and still more preferably 0.5 to 0.8%.

Described below are the method to produce a polyamide multifilament to constitute the air bag fabric and the method to produce an air bag fabric.

The polyamide multifilament is produced with the following method based on a generally known melt-spinning process.

First, polyamide chips are supplied to an extruder type spinning machine, and sent to the spinning orifice by a lightweight pump, followed by melt-spinning at 290 to 300° C. The spinning orifices should preferable be designed so that the back pressure will be 60 kg/cm$^2$ or more, more preferably 80 to 120 kg/cm$^2$ to decrease the variation in the single fiber fineness and depress the fuzzing during the weaving process. The discharge holes may be arranged along concentric circles, and the number of such circles should preferably be 2 to 8, more preferably 3 to 6. If the number is too small, the distance between single fibers will become so small that single fibers hit each other during spinning, possibly leading to their fusion, whereas if the number is too large, cooling causes a large variation in physical properties among single fibers, which is unpreferable. The diameter of the circle producing by connecting the discharge holes arranged along the circumference is maintained smaller than the diameter of the slow cooling cylinder (heating cylinder) and the circular cooling equipment, and the difference should preferably be 8 to 25 mm, more preferably 10 to 20 mm. The slow cooling cylinder is provided with the aim of preventing a decrease in strength and elongation by cooling the yarn slowly immediately after the melt-spinning process. In general, this is achieved by heating or heat insulation using a thermal insulator so that the temperature in the cylinder before cooling is maintained higher than the crystallization temperature of the extruded molten yarn. Thus, it is also called heating cylinder or heat insulation cylinder. If the circumferential holes are located too near to the slow cooling cylinder (heating cylinder) or the circular cooling equipment, the yarn before solidification is likely to come in contact with the equipment, making the spinning process unstable, whereas if the distance is too large, the yarn will not be cooled sufficiently, making it impossible to obtain a high-strength, high-elongation polyamide multifilament.

It is preferable that steam is given to the spun yarn discharged from the orifice. In the case of melt-spinning of polyamide fiber, inert gas, steam in particular, is commonly retained immediately below the orifice, but there have been no studies that discuss the effect of steam on the mechanical characteristics of industrial polyamide fiber. Surprisingly, it was found that steam served to improve both the strength and elongation and decrease the unevenness in fineness when high strength polyamide multifilament with a small single yarn fineness was produced with a circular cooling equipment. The steam blowout holes may be generally known ones with a diameter of about 0.5 to 5 mm and a length of about 1 to 10 mm. Excessive supply of steam can decrease the strength and elongation and cause a large unevenness in fineness as well as fuzzing and breakage of the yarn and, therefore, the blowout pressure should preferably be 100 to 600 Pa, more preferably 200 to 400 Pa. The blowout pressure is a static pressure that can be determined by measuring the static pressure of the steam flowing into the holes using a static pressure measuring equipment.

The yarn provided with steam is allowed to pass through a tubular slow cooling cylinder and then a tubular circular cooling equipment to ensure sufficient cooling to complete the solidification. It is preferable that the inside diameter of the slow cooling cylinder is equal to that of the circular cooling equipment to prevent turbulence in air flow in the portion where the slow cooling cylinder comes in contact with the circular cooling equipment in the tube. The length should preferably be 30 to 150 mm, more preferably 50 to 100 mm, and still more preferably 50 to 80 mm, and it is also preferable that heating is performed so that the atmosphere temperature in the cylinder is 250 to 350° C., followed by cooling in the circular cooling equipment. The use of a slow cooling cylinder serves to maintain heat insulation at the orifice surface and control the deformation of the yarn, making it possible to produce a polyamide fiber with a high toughness. The polyamide fiber can have a uniform unevenness in thickness in the length direction if the slow cooling cylinder has a length in the range. If the single fiber fineness is less than 1.5 dtex, only the circular cooling equipment may be installed without using a slow cooling cylinder, and the spun yarn may start to be cooled earlier to prevent extreme deterioration in the thickness unevenness of the yarn in the length direction. In this case, it is preferable for hot air of 100 to 250° C. to be supplied at a constant position within 100 mm of the top of the circular cooling equipment to heat-insulate the orifice surface to obtain a high-strength, high-elongation polyamide multifilament.

When cooling the yarn in the circular cooling equipment, cooling air of 10 to 50° C. should preferably be used to ensure sufficient cooling of the polyamide down to its glass transition point. The circular cooling equipment may be of a generally known basic structure. For instance, the cylinder body may be made of porous material having many capillary pores so that the cooling air supplied into the cooling cylinder internal can be adjusted and blown out from cooling air blowout holes toward the yarn. For adjustment of the cooling air speed, it is preferable to provide a punched plate, mesh or porous material, for instance, in the air introduction portion of the cooling cylinder element. A constitution with the following features is preferable to obtain a high-strength, high-elongation polyamide multifilament with a low single yarn fineness that serves to produce the air bag fabric.

The cooling air is supplied from the circumferential side of the discharge holes toward the center. This constitution serves to supply a sufficient amount of cooling air to cool a polyamide multifilament which is difficult to cool as compared with polyester-based ones. If the air is supplied from the center toward the circumference, the single fibers will be pushed outward more than necessary to produce the polyamide multifilament, or an excessively long cooling equipment will be required, necessitating large-size equipment, which is unpreferable.

It is preferable that the cooling cylinder is much longer than the circular cooling equipment proposed conventionally, and it should preferably have a cooling air blowout length in the range of 600 to 1,200 mm, more preferably 800 to 1,000 mm. If it is 600 mm or more, the polyamide multifilament can be cooled sufficiently to achieve high mechanical characteristics and fuzzing quality. It is preferably 1,200 mm or less to prevent the equipment from becoming too long.

The difference between the cooling cylinder's internal pressure and the atmospheric pressure should preferably be 500 to 1,200 Pa, more preferably 600 to 1,100 Pa, and still more preferably 800 to 1,000 Pa, for applying a pressure to supply cooling air. The pressure difference is the static pressure of inflow gas coming in the cooling cylinder as measured with a static pressure measuring equipment. In the case of a conventional-type cross flow cooling equipment, fuzzing quality tended to deteriorate as the mechanical characteristics of the multifilament declined as a result of decreasing the cooling air supply rate. When the circular cooling equipment was used, on the other hand, the pressure difference had little influence on the physical properties of the polyamide multifilament, and the mechanical characteristics could be controlled only by adjusting the draw ratio if the difference was, for instance, about 200 Pa. Unexpectedly, it was found that fuzzing was depressed considerably when it is maintained at 500 Pa or more. It is preferably 1,200 Pa or less, because the air speed does not have to be very high, and contact between yarns can be prevented easily.

Furthermore, it is preferable that the speed of cooling air in the length direction of the equipment is not uniform, and that the upper side air speed $V_U$ and the lower side air speed $V_L$ are 10 to 30 m/min and 40 to 80 m/min, respectively. $V_U$ should preferably be smaller than $V_L$, with $V_L/V_U$ being in the range of 2 to 3. It is more preferable that $V_U$ and $V_L$ are in the range of 15 to 25 m/min and 50 to 70 m/min, respectively. The fiber's physical properties can be improved without deterioration in the thickness unevenness in the yarn's length direction by largely changing the air speed ratio in the air speed range at least at 2 stages in the equipment's length direction. By performing slow cooling at the upper side, in particular, the fiber's toughness improves and the elongation changes by about 2 to 5% when the strength is the same. Such a change in the air speed ratio should preferably take place at a position away from the top of the cooling air blower by 10 to 50%, more preferably 15 to 45%, of the overall length. A possible means is to provide a donut-like porous component at the ratio-changing position between the outer cylinder of the cooling cylinder and the flow adjustment cylinder made of porous material so that an additional pressure difference between the upper and lower portions is produced at the position to change the air speed between the upper and lower portions, and another means is to use a cooling equipment of a two-stage structure and control the difference between the cylinder's internal pressure and the atmospheric pressure. Either means will work appropriately.

The yarn swings too seriously at the spinning portion and the contact between single fibers cannot be controlled when a conventional-type cross flow cooling equipment is used in an attempt to produce a polyamide fiber with a total fineness of 200 to 700 dtex and a single fiber fineness of 1 to 2 dtex. Compared with this, the distance between the cooling air and the spun yarn is small in the method and, therefore, sufficient cooling can be maintained if the speed of cooling air before solidification of the yarn is decreased. Furthermore, air streams are combined to form descending air flows to allow the horizontal component of the cooling air speed to be decreased largely. This is thought to make yarn-making possible while controlling its swing.

Subsequently, the resulting cooled yarn is provided with a lubricant with a generally known method, pulled by a pulling roll, stretched, and wound up. The lubricant may be a generally known one. To prevent the single yarn from being wound up on the pulling roll, the amount of the lubricant attached on the surface should preferably be 0.3 to 1.5 wt %, more preferably 0.5 to 1.0 wt %.

The spinning velocity, which is defined by the rotating speed of the pulling roll, should preferably be 500 to 1,000 m/min, more preferably 700 to 900 m/min. If the spinning velocity is 500 m/min or more, the final production speed will be sufficiently high, allowing a polyamide fiber to be produced at low cost. If it is 1,000 m/min or less, frequent occurrence of yarn breakage or fuzzing can be prevented, which is preferable.

These spun yarns produced with the method can be stretched, relaxed, heat-treated, and wound up with a generally known method. For instance, they may be subjected to a two- or three-stage stretching and heat treatment process at 100 to 250° C., followed by a 1 to 10% relaxation and heat treatment process at 50 to 200° C.

Furthermore, the yarns may be entangled to an appropriate degree depending on the type of weaving machine and the speed of weaving. When using the method, it is not necessary to give a high degree of entanglement, and an appropriate entangling machine may be used to achieve 15 to 30 entanglements per meter. If the number is much lower than 15 per meter or higher than 30 per meter, it tends to become difficult for the yarn to pass the subsequent steps smoothly. Similarly, the strength of entanglement may be in the generally known range.

Furthermore, there are no specific limitations on the cross-sectional shape of the single yarn of the polyamide fiber, and it may be circular, Y-shaped, V-shaped, flattened, in other non-circular shapes, or hollow, though it should preferably be circular.

Thus, a polyamide multifilament suitable as material for air bags with a total fineness 200 to 700 dtex and a single fiber fineness of 1 to 2 dtex that cannot be produced with the conventional methods can be produced with such good features as a strength of preferably 8 to 9 cN/dtex, elongation of 20 to 25%, boiling water shrinkage of 4 to 10%, freedom from yarn unevenness, low cost, high yarn-making performance, and high fuzzing quality. Thus, yarns can be produced with the direct spinning-stretching method, at a spinning speed of 3,000 m/min or more, preferably 3,500 m/min or more, by a multi- (eight- or more) yarn simultaneous stretching process.

Then, the air bag fabric is produced with the method described below.

First, yarns of the material with the total fineness and single fiber fineness are warped and set on a weaving machine, followed by similar operation for the weft. The useful weaving machines include, for instance, water jet loom, air jet loom and rapier loom. To achieve a high productivity, in particular, the water jet loom is preferable because high-speed weaving is performed relatively easily.

Weaving should preferably be performed with a warp tension of 75 to 230 cN/yarn, more preferably 100 to 200 cN/yarn. A warp tension adjusted to this range serves to decrease the spaces among the fibers in the yarn bundles in the multifilament that constitutes the fabric, leading to a decrease in the air permeation. Furthermore, as the weft yarns are supplied, the warp under the aforementioned tension works to bend the weft to increase the fabric weave constraint in the weft direction, leading to an increased seam slippage resistance, which serves to prevent air leakage from being caused by seam shift in sewed portions during production of the bag portion of the air bag. If the warp tension is 75 cN/yarn or more, the warp-weft contact area in the fabric is increased to improve the edgecomb resistance. This is preferable also because the spaces among the single fibers are decreased to reduce the air permeability of the fabric. If the tension is 230 cN/yarn or less, the warp will be free from fuzzing to increase the weaving performance.

Specific methods to adjust the warp tension to the aforementioned range include controlling the warp supply speed of the weaving machine and controlling the weft driving speed. Whether the warp tension is in the aforementioned range during weaving can be confirmed by determining the tension on one warp yarn with a tension measuring equipment at a position between the warp beam and the whip roll during weaving.

When the warp is shed, furthermore, the tension on the top yarns and that on the bottom yarns should preferably differ by 10 to 90%. This enhances the aforementioned bent structure of the warp, and the warp and the weft are pressed strongly against each other to increase the friction resistance between the yarns, leading to an improved edgecomb resistance.

The useful methods to make the tension on the top yarns and that on the bottom yarns to differ when the warp is shed include, for instance, install the whip roll at a somewhat high position so that the traveling distance of the top yarns will differ from that of the bottom yarns. For instance, a guide roll is provided between the whip roll and the heddle to allow this guide roll to act to shift the shedding fulcrum upward or downward from the warp line. As a result, the traveling distance of either the top or the bottom yarns becomes longer than that of the others to increase the tension, making the tension on the top yarns differ from that of the bottom yarns. With respect to the position of the guide roll, it should preferably be installed at a position away from the whip roll by 20 to 50% of the distance between the whip roll and the heddle. The fulcrum of shedding should preferably be 5 cm or more away from the warp line.

Another method to make a difference between the tension on the top yarns and that on the bottom yarns is, for instance, to provide a cam drive mechanism in the shedding equipment to make the dwell angle of either the top or the bottom yarns larger by 100 or more degrees than that of the others. A larger tension will be applied to the yarns with the larger dwell angle.

The temple of the weaving machine to be used should preferably be a bar temple. The use of a bar temple allows beating-up to be performed while holding the entire fabric fell. This allows the spaces among the synthetic fiber filaments to be reduced, leading to a decreased air permeation and a increased seam slippage resistance.

After finishing the weaving, scouring, heat setting, or other processing steps may be carried out as needed. If a particularly small air permeation is necessary, the fabric surface may be coated with resin or the like, or a film may be applied to form a coated fabric, as needed.

The air bag fabric has a low air permeability, improved mechanical characteristics, and increased seam slippage resistance, in addition to high foldability for storage of air bags which has been unable to be improved together with the aforementioned properties. We make it possible not only to produce air bag fabrics with well-balanced various characteristics, but also those air bag fabrics having a drastically decreased air permeation and increased seam slippage resistance with the same level of foldability as the conventional products, or air bag fabrics having a low fabric density and an equivalent seam slippage resistance, which are low in price and high in foldability as a result of the decrease in the number of fibers. Thus, the air bag fabric can be used preferably for the driver seat, passenger seat, and backseat, and side walls.

EXAMPLES

Our base cloths, yarns and methods are described in detail below with reference to Examples. The definitions and measuring methods for the characteristics as referred to are as described below.

(1) Total fineness:

The fineness based on corrected weight for a predetermined load of 0.045 cN/dtex was measured according to JIS L1013(1999) 8.3.1 A to provide the value of total fineness.

(2) Number of single fibers:

Calculations were made according to the method specified in JIS L1013(1999) 8.4.

(3) Single fiber fineness:

The total fineness was divided by the number of single fibers to calculate this value.

(4) Strength and elongation:

Measurements were made under the constant-rate extension conditions for the standard test specified in JIS L1013 8.5.1. The test was carried out using a Tensilon tester (UCT-100 supplied by Orientec Co., Ltd.) with a grip distance of 25 cm and a tension speed of 30 cm/min. The elongation was determined from the point for the maximum strength in the S-S curve.

(5) Boiling water shrinkage:

Yarns were sampled into a skein-like form and conditioned for 24 hours or more in a controlled temperature and humidity room at 20° C. and 65% RH, and a load equivalent to 0.045 cN/dtex was applied to the specimen, followed by measuring the length $L_0$. Then, this specimen was immersed in boiling water for 30 minutes in a tensionless state, and air-dried for 4 hours in the aforementioned controlled temperature and humidity room, followed by measuring the length $L_1$, after applying a load equivalent to 0.045 cN/dtex. The boiling water shrinkage was calclulated from the lengths L0 and L1 by the following equation:

$$\text{Boiling water shrinkage}=[(L_0-L_1)/L_0]\times 100\ (\%).$$

(6) Fineness unevenness:

The half value was measured with Uster Tester Monitor C supplied by Zellweger Uster AG. The NEAT mode was used to make measurements for 125 m at a yarn speed of 25 m/min.

(7) Fuzzing evaluation:

The resulting fiber package was rewound at a speed of 500 m/min, and fluff were detected with a laser-type fuzz detector (Flytech V supplied by Heberlein) installed 2 mm away from the yarn during rewinding. The total number of fluff detected was converted into the number per 100,000 m.

(8) Air speed:

A measuring apparstus (Anemomaster supplied by Kanomax Japan, Inc.) was placed in contact with the cooling air blower at some measuring points to take measurements. The measuring points were at distances 0, 50, and 100 mm from the top of the cooling air blowout section and then at intervals of 100 mm down to the bottom of the cylinder, and each distance, measurements were made at four positions on the circumference in the directions at right angles to each other. The average of the four air speed measurements was taken as the air speed at each distance from the top of the cooling air blowout section. Then, in the case where the upper and lower air speeds were changed by specially designed equipment components, the measurements were divided into two groups by the boundary between the upper and lower portions, while in the case where the air speed ratio was not changed intentionally, the upper and lower portions were divided at a position 300 mm from the top. The integral for the air speed sections was divided by each effective cooling length to determine the values of $V_U$ and $V_L$.

If it is assumed that the air speed and cooling air blowout length at a position a mm from the top of the cylinder are Va and L, respectively, for instance, calculations can be made by the following equation for a test system in which the air speed ratio was changed intentionally at a position 350 mm from the top:

$$V_U=[50(V_0+2V_{50}+V_{100})+100(V_{100}+V_{200})+150(V_{200}+V_{300})]2/350$$

$$V_L=[150(V_{400}+V_{500})+100(V_{500}+V_{600})+\ldots]/2/(L-350).$$

"..." means that similar calculations are made after 600 mm up to the maximum measuring point and summed up.

(9) Fabric thickness:

The thickness was measured with a thickness gauge at five positions of each specimen according to JIS L 1096:1999 8.5. A load of 23.5 kPa was applied and held for 10 seconds for conditioning, and then thickness measurements were made, followed by calculating the average.

(10) Gray fabric density and fabric density of warp and weft:

Measurements were made according to JIS L 1096:1999 8.6.1.

A specimen was placed on a flat table, and unnatural creases and tension were removed. The number of warp and weft yarns for a 2.54 cm section was counted for five different positions, followed by calculating the average.

(11) Cover factor:

Assuming that the total fineness of the warp and weft yarns was Dw (dtex) and Df (dtex), respectively, and the fabric density of the warp and weft yarns was Nw (number of yarns/2.54 cm) and Nf (number of yarns/2.54 cm), respectively, calculations were made by the following equation:

$$\text{Warp's cover factor: } CFw=(Dw\times 0.9)^{1/2}\times Nw$$

$$\text{Weft's cover factor: } CFf=(Df\times 0.9)^{1/2}\times Nf$$

$$\text{Total cover factor: } CF=CFw+CFf.$$

(12) Fabric's basis weight:

According to JIS L 1096:1999 8.4.2, three 20 cm×20 cm specimens were sampled and their weight (g) was measured. The average was calculated in the form of weight per 1 $m^2$ ($g/m^2$).

(13) Tensile strength:

According to JIS K 6404-3 6. Test Method B (Strip Method), five specimens each were taken for the warp direction and the weft direction, and some yarns were removed from both sides of each specimen to adjust the width to 30 mm. In a constant-speed type tester, the specimen was set with a grip distance of 150 mm and pulled at a tension speed of 200 mm/min until it was broken. The maximum load during the pulling period was measured and the average was calculated for the warp direction and the weft direction.

(14) Rupture elongation:

According to JIS K 6404-3 6. Test Method B (Strip Method), five specimens each were taken for the warp direction and the weft direction, and some yarns were removed from both sides of each specimen to adjust the width to 30 mm. Lines were drawn with an interval of 100 mm in the central region of each specimen, and in a constant-speed type tester, the specimen was set with a grip distance of 150 mm and pulled at a tension speed of 200 mm/min until it was broken. The distance between the lines was measured, and the rupture elongation was calculated by the following equation. The average was calculated for the warp direction and the weft direction.

$$E=[(L-100)/100]\times 100$$

where E denotes the rupture elongation (%) and L represents the distance between the lines at rupture (mm).

(15) Tear strength:

According to JIS K 6404-4 6. Test Method B (Single Tongue Method), five 200 mm×76 mm rectangular specimens each were taken in the warp direction and the weft direction. A 75 mm cut was made from the center of a short side at right angles to the short side of each specimen, and it was set with a grip distance of 75 mm and pulled at a tension speed of 200 mm/min until it was torn. The load applied was measured at the time of breakage. In the tear test load chart recorded, the first peak was neglected and the three largest of the remaining maximums were taken and averaged. Averages were calculated for both the warp direction and the weft direction.

(16) Air permeation:

According to JIS L 1096:1999 8.27.1 A Method (Frajour Method), the air permeation was measured at a test pressure difference of 19.6 kPa. Five 20 cm×20 cm specimens were taken from different portions of each sample. For the test, a specimen was placed on one end of a cylinder with a diameter of 100 mm, and fixed firmly to avoid air leakage, and the test pressure difference was adjusted to 19.6 kPa using a regulator. The amount of air passing through the specimen was measured with a flow meter. The measurements taken from the five specimens were averaged.

(17) Packability:

Measurements were made according to ASTM D6478-02.

(18) Edgecomb resistance:

According to ASTM D6479-02, a mark was made at a position 5 mm from the edge of a fabric specimen, and needles were stuck accurately at the position, followed by measurement.

The edgecomb resistance in the warp direction was determined by sticking pints along weft yarns, moving the pins to shift the weft yarns in the warp direction, and measuring the maximum load. The edgecomb resistance in the weft direction was determined by sticking pints along warp yarns, moving the pins to shift the warp yarns in the weft direction, and measuring the maximum load.

(19) Warp tension:

Using a Check Master (registered trademark) (type: CM-200FR) supplied by Kanai Koki Co., Ltd., the tension applied to a single warp yarn in the region at the center between the warp beam and the whip roll was determined during operation of the weaving machine.

(20) Tension on top and bottom yarns in warp yarn shed:

The weaving machine was stopped with the warp yarns shed, and the tension applied to a single top warp yarn was determined to give the top yarn tension by using a tension meter used in (17) above at a position between the whip roll and the heddle (between the guide roll and the heddle in the case where a guide roll has been installed between the whip roll and the heddle). Similarly, the tension applied to a bottom-side warp yarn was also determined to give the bottom yarn tension.

Examples 1 to 11

A 5 wt % aqueous solution of copper acetate was added as antioxidant to nylon 66 chips produced by liquid phase polymerization, followed by mixing. An amount of copper equivalent to 68 ppm relative to the polymer weight was added and adsorbed. Then, a 50 wt % aqueous solution potassium iodide and a 20 wt % aqueous solution of potassium bromide were added and adsorbed so that each accounts for 0.1 part by weight relative to 100 parts by weight of the polymer chips. A batch-type solid phase polymerization equipment was used to perform solid phase polymerization to produce nylon 66 pellets with a sulfuric acid relative viscosity of 3.8. The resulting nylon 66 pellets were supplied to the extruder and sent to the spinning orifice by a measuring pump after adjusting the discharge rate so that two yarns with a total fineness as shown in Tables 1 and 2, followed by melt-spinning at 295° C. The sulfuric acid relative viscosity is determined by dissolving a 2.5 g specimen in 25 cc of 96% concentrated sulfuric acid making a measurement at a constant temperature in a temperature controlled bath of 25° C. suing an Ostwald viscometer. In each spinning orifice, discharge holes with a diameter of 0.22 mm were provided along four concentric circles. Their number was such that two yarns composed of as many single fibers as shown in Tables 1 and 2 were to be produced, that is, twice the number of single fibers shown in Tables 1 and 2. The circle made by connecting the outmost circumferential discharge holes had a diameter smaller by 14 mm than the inside diameter of the heating cylinder and cooling cylinder. In Examples 6 to 11, a circular steam supplier having 12 holes, each with a diameter of 2 mm and depth of 4 mm, arranged at regular intervals was used to allow steam heated at 260° C. to be blown out under a pressure as shown in Tables 1 and 2 diagonally at an angle of 60° C. from a position 50 mm below the yarn discharge face. In addition, a slow cooling cylinder with a length as shown in Tables 1 and 2 heated at 300° C. was provided immediately below the orifice, and a circular cooling equipment of a tubular shape with a cooling air blowout length as shown in Tables 1 and 2 was used to supply cooling air of 20° C. by applying a pressure so that the difference between the cooling cylinder's internal pressure and the atmospheric pressure would be as shown in Tables 1 and 2 to cool and solidify the spun yarn. A Fujibon element supplied by Fuji Filter Mfg Co., Ltd., which is produced from a phenol resin impregnated cellulose ribbon with a thickness of 4.6 mm and having pores with a filtering accuracy of 40 μm is wound helically and molded in a tubular shape, was used as the tube that constituted the cooling air blowout portion of the cooling cylinder. Furthermore, a donut-shaped perforated plate with an opening ratio of 22.7% was provided at a position 350 mm from the top of the cooling air blowout portion of the cooling cylinder to make the cooling air speed different between the upper and lower parts of the cylinder. Then, a nonaqueous oil solution containing a lubricant and other agents was given to the cooled and solidified yarn, and the spun yarn was taken up on a spun yarn take-up roller. Subsequently, the yarn was supplied continuously to a stretching and heat treatment zone and subjected to direct spinning stretching to produce a nylon 66 fiber. The rotating speed of the stretching roller with the highest rotating speed (hereinafter, stretching speed) was maintained constant at 3,600 m/min and the rotating speed of the take-up roller was adjusted so that the overall draw ratio, which is defined as the ratio between the take-up speed and the stretching speed, would be as shown in Tables 1 and 2.

The yarn taken up was slightly elongated by 5% between the take-up roller and the yarn feed roller, and then subjected to the first stage stretching between the yarn feed roller and the first stretching roller that had a rotating speed of 2, followed by the second stage stretching between the first stretching roller and the second stretching roller. Subsequently, heat treatment for 6% relaxation was carried out between the second stretching roller and the relaxation roller, and the yarn was subjected to entanglement treatment in an entangling equipment, and wound up on a winding machine. The surface temperatures of these rollers were set at room temperature for the take-up roller, 40° C. for the yarn feed roller, 140° C. for the first stretching roller, 230° C. for the second stretching roller, and 150° C. for the relaxation roller. The nonaqueous oil solution supply rate was controlled so that the oil adhered to the yarn would account for 1.0 wt %. The entanglement treatment was carried out by blowing highly pressured air at right angles to the travelling yarn in an entangling equipment. A guiding means was provided before and after the entangling equipment to control traveling yarn, and the pressure for air blowout was maintained constant at 0.35 MPa.

Tables 1 and 2 show fiber production conditions, including the average air speed measurements in the upper and lower portions of the cooling cylinder, and characteristics of the nylon 66 fibers produced.

A 50 kg portion of the nylon 66 fiber produced with the method was rewound at a speed of 500 m/min, and the fuzz contained in the fiber package was observed with a laser-type fuzz detector. Results are shown Tables 1 and 2.

In Examples 1 to 11, it was possible to produce polyamide fiber with little fuzzing and a single fiber fineness of 1 to 2 dtex having sufficiently good mechanical characteristics.

TABLE 1

| | Unit | Example 1 | Example 2 | Example 3 | Example 4 | Example 5 | Example 6 | Example 7 | Example 8 |
|---|---|---|---|---|---|---|---|---|---|
| Cooling equipment | — | cyclic | cyclic | cyclic | cyclic | cyclic | cyclic | cyclic | cyclic |
| Steam pressure | Pa | none | none | none | none | none | 300 | 300 | 300 |
| Slow cooling cylinder length | mm | 100 | 100 | 100 | 100 | 100 | 100 | 100 | 100 |
| Cooling air blowout length | mm | 800 | 800 | 800 | 800 | 800 | 800 | 800 | 800 |
| Difference from atmospheric pressure | Pa | 600 | 600 | 900 | 900 | 750 | 600 | 600 | 900 |
| $V_U$ | m/min | 20 | 20 | 26 | 26 | 23 | 20 | 20 | 26 |
| $V_L$ | m/min | 55 | 55 | 76 | 76 | 66 | 55 | 55 | 76 |
| $V_L/V_U$ | — | 2.8 | 2.8 | 2.9 | 2.9 | 2.9 | 2.8 | 2.8 | 2.9 |
| Overall draw ratio | — | 4.10 | 4.00 | 4.20 | 4.00 | 3.50 | 4.25 | 4.15 | 3.90 |
| Total fineness | dtex | 350 | 235 | 470 | 350 | 280 | 350 | 235 | 470 |
| Number of single fibers | — | 192 | 136 | 272 | 272 | 272 | 192 | 136 | 384 |
| Single fiber fineness | dtex | 1.8 | 1.7 | 1.7 | 1.3 | 1.0 | 1.8 | 1.7 | 1.2 |
| Strength | cN/dtex | 8.5 | 8.9 | 8.0 | 8.5 | 8.5 | 8.7 | 8.7 | 8.5 |
| Elongation | % | 22.9 | 23.4 | 20.7 | 20.1 | 21.3 | 23.8 | 24.5 | 22.5 |
| Boiling water shrinkage | % | 6.2 | 6.2 | 6.4 | 6.4 | 6.2 | 6.7 | 6.5 | 6.3 |
| Fineness unevenness | % | 1.8 | 1.7 | 1.9 | 2.0 | 1.5 | 1.0 | 0.8 | 1.0 |
| Fluff evaluation | number/$10^5$ m | 2 | 4 | 18 | 12 | 18 | 1 | 2 | 5 |

TABLE 2

| | Unit | Example 9 | Example 10 | Example 11 | Comparative example 1 | Comparative example 2 | Comparative example 3 | Comparative example 4 | Comparative example 5 |
|---|---|---|---|---|---|---|---|---|---|
| Cooling equipment | — | cyclic | cyclic | cyclic | cross flow | cyclic | cyclic | cyclic | cyclic |
| Steam pressure | Pa | 300 | 100 | 600 | 600 | none | none | none | none |
| Slow cooling cylinder length | mm | 50 | 100 | 100 | 100 | 100 | 100 | 100 | none |
| Cooling air blowout length | mm | 800 | 800 | 800 | 1500 | 800 | 800 | 500 | 800 |
| Difference from atmospheric pressure | Pa | 900 | 600 | 600 | — | 750 | 300 | 450 | 600 |
| $V_U$ | m/min | 26 | 20 | 20 | 30 | 23 | 14 | 36 | 20 |
| $V_L$ | m/min | 76 | 55 | 55 | | 66 | 33 | 54 | 55 |
| $V_L/V_U$ | — | 2.9 | 2.8 | 2.8 | | 2.9 | 2.4 | 1.5 | 2.8 |
| Overall draw ratio | — | 4.20 | 4.25 | 4.25 | 4.30 | 3.50 | 3.85 | 4.25 | 4.25 |
| Total fineness | dtex | 350 | 350 | 350 | (235) | (235) | 350 | 715 | 350 |
| Number of single fibers | — | 192 | 192 | 192 | (136) | (272) | 192 | 272 | 192 |
| Single fiber fineness | dtex | 1.8 | 1.8 | 1.8 | (1.7) | (0.9) | 1.8 | 2.6 | 1.8 |
| Strength | cN/dtex | 8.8 | 8.7 | 7.9 | Unable | Unable | 8.5 | 8.5 | 7.9 |
| Elongation | % | 24.8 | 23.6 | 24.6 | to spin | to spin | 22.2 | 19.4 | 22.2 |
| Boiling water shrinkage | % | 6.2 | 6.6 | 6.3 | | | 6.3 | 6.3 | 6.1 |
| Fineness unevenness | % | 0.7 | 1.0 | 1.8 | | | 2.4 | 2.1 | 0.9 |
| Fluff evaluation | number/$10^5$ m | 0 | 1 | 20 | | | 113 | 31 | 228 |

Comparative Example 1

A cross flow type cooling equipment with a length of 1,500 mm was used to supply uniform cooling air at 30 m/min to perform simultaneous production of 2 yarns, each having a total fineness 235 dtex and composed of 136 single fibers, at a stretching speed of 3,000 m/min. The spinning orifice used had discharge holes arranged at 7.5 mm or more intervals to make an attempt to produce nylon 66 fiber under the conditions shown in Table 2. A procedure otherwise the same as that in Example 1 was carried out.

Despite a lower stretching speed than in Examples 1 to 11, the yarn was found to swing seriously in the cooling section to cause the single fibers to hit each other in the cooling section. As a result, broken single yarns twined around the take-up roll, making it impossible even to take samples.

Comparative Examples 2 and 3

Except for the production conditions shown in Table 2, the same procedure as in Example 1 was carried out to produce nylon 66 fiber.

Characteristics of the resulting fiber and results of fuzz evaluation are shown in Table 2.

In Comparative Example 2, the single fiber fineness was so small that yarn breakage took place frequently, making it impossible for the wind-up machine to wind up the nylon 66 fiber. In Comparative Example 3, the fiber physical properties were as good as those achieved in Examples, but the difference between the cooling cylinder's internal pressure and the atmospheric pressure was so small that the resulting fiber suffered serious fuzzing and was not suitable as material for air bags to be manufactured through high speed weaving.

Comparative Example 4

The cooling air blowout length of the cooling cylinder was set at 500 mm, and the production conditions shown in Table 2 were adopted without using mechanical means of changing the air speed ratio between the upper and lower portions. Except for this, the same procedure as in Example 1 was carried out to produce nylon 66 fiber. The two yarns coming from one orifice were combined on the take-up roll into one yarn, which was, without being wound up, subjected to stretching and relaxation/heat treatment, followed by winding by a wind-up machine.

Fiber characteristics and results of fuzz evaluation of the resulting nylon 66 fiber are shown in Table 2.

The resulting nylon 66 fiber was so low in elongation, i.e., low in toughness, that it suffered increased fuzzing compared with Examples 1 to 11.

Comparative Example 5

Except that a slow cooling cylinder was not used and the production conditions were as shown in Table 2, the same procedure as in Example 1 was carried out to produce nylon 66 fiber.

Fiber characteristics and results of fuzz evaluation of the resulting nylon 66 fiber are shown in Table 2.

The resulting nylon 66 fiber was so low in elongation, i.e., low in toughness, that it suffered increased fuzzing compared with Examples 1 to 11.

Reference Examples 1 to 5

A yarn-making equipment that was the same as in Comparative Example 1 except for the number of discharge holes in the spinning orifice was used to produce nylon 66 fiber under the conditions shown in Table 3 at a stretching speed of 3,200 m/min in Reference Example 1 and a stretching speed of 3600 m/min in Reference Examples 2 to 5.

Characteristics of the resulting fiber and results of fuzz evaluation are shown in Table 3.

TABLE 3

| | Unit | Reference example 1 | Reference example 2 | Reference example 3 | Reference example 4 | Reference example 5 |
|---|---|---|---|---|---|---|
| Cooling equipment | — | cross flow | cross flow | cross flow | cross flow | cross flow |
| Steam pressure | Pa | 600 | 600 | 600 | 600 | 600 |
| Slow cooling cylinder length | mm | 100 | 100 | 100 | 100 | 100 |
| Cooling air blowout length | mm | 1500 | 1500 | 1500 | 1500 | 1500 |
| Difference from atmospheric pressure | Pa | — | — | — | — | — |
| $V_U$ | m/min | 30 | 30 | 30 | 30 | 30 |
| $V_L$ | m/min | | | | | |
| $V_L/V_U$ | — | — | — | — | — | — |
| Overall draw ratio | — | 4.50 | 4.50 | 4.50 | 4.50 | 4.50 |
| Total fineness | dtex | 350 | 350 | 470 | 235 | 235 |
| Number of single fibers | — | 136 | 72 | 136 | 72 | 36 |
| Single fiber fineness | dtex | 2.6 | 4.9 | 3.5 | 3.3 | 6.5 |
| Strength | cN/dtex | 8.5 | 8.5 | 8.5 | 8.5 | 8.5 |
| Elongation | % | 25.0 | 24.0 | 24.0 | 24.0 | 23.0 |
| Boiling water shrinkage | % | 6.2 | 6.2 | 6.2 | 6.2 | 6.2 |
| Fineness unevenness | % | 0.7 | 0.5 | 0.7 | 0.6 | 0.5 |
| Fluff evaluation | number/$10^5$ m | 1 | 1 | 1 | 1 | 0 |

Example 12

The nylon 66 fiber produced in Example 1 was used in untwisted state as warp and weft to weave a fabric with a warp's gray fabric density of 56/2.54 cm and a weft's gray fabric density of 63/2.54 cm.

A water jet loom was used as weaving machine, and a bar temple was provided between the beating-up portion and the friction roller to grip the fabric. A guide roll was installed between the whip roll and the heddle at a position 40 cm from the whip roll to lift the warp by 7 cm from the warp line.

The weaving conditions included a warp tension during weaving of 147 cN/yarn, a top yarn tension during weaving machine downtime of 118 cN/yarn, a bottom yarn tension of 167 cN/yarn, and a weaving machine rotating speed of 500 rpm.

Then, a pin tenter drier was used to heat-set the resulting fabric at 160° C. for one minute under the size control conditions of a width shrinkage rate of 0% and an overfeed rate of 0%.

Characteristics of the resulting air bag fabric are shown in Table 4. The resulting air bag fabric had an unexpectedly high edgecomb resistance to improve the seam slippage resistance. Furthermore, it was also low in air permeability and high in foldability.

Example 13

The nylon 66 fiber produced in Example 1 was used in an untwisted state as warp and weft to weave a fabric with a warp's gray fabric density of 62.0/2.54 cm and a weft's gray fabric density of 63.0/2.54 cm.

A water jet loom was used as weaving machine, and a bar temple was provided between the beating-up portion and the friction roller to grip the fabric. No guide roll was installed between the whip roll and the heddle.

The weaving conditions included a warp tension during weaving of 150 cN/yarn, a top yarn tension during weaving machine downtime of 150 cN/yarn, a bottom yarn tension of 150 cN/yarn, and a weaving machine rotating speed of 500 rpm.

Then, a pin tenter drier was used to heat-set the resulting fabric at 160° C. for one minute under the size control conditions of a width shrinkage rate of 0% and an overfeed rate of 0%.

Characteristics of the resulting air bag fabric are shown in Table 4. The resulting air bag fabric had an unexpectedly high edgecomb resistance to improve the seam slippage resistance. Furthermore, it was also low in air permeability and high in foldability.

Example 14

The nylon 66 fiber produced in Example 1 was used in an untwisted state as warp and weft to weave a fabric with a warp's gray fabric density of 58.0/2.54 cm and a weft's gray fabric density of 59.5/2.54 cm.

A water jet loom was used as weaving machine, and a bar temple was provided between the beating-up portion and the friction roller to grip the fabric. No guide roll was installed between the whip roll and the heddle.

The weaving conditions included a warp tension during weaving of 150 cN/yarn, a top yarn tension during weaving machine downtime of 150 cN/yarn, a bottom yarn tension of 150 cN/yarn, and a weaving machine rotating speed of 500 rpm.

Then, a pin tenter drier was used to heat-set the resulting fabric at 160° C. for one minute under the size control conditions of a width shrinkage rate of 0% and an overfeed rate of 0%.

Characteristics of the resulting air bag fabric are shown in Table 4. The resulting air bag fabric had an unexpectedly high edgecomb resistance to improve the seam slippage resistance. Furthermore, it was also low in air permeability and high in foldability.

Example 15

The nylon 66 fiber produced in Example 8 was used in an untwisted state as warp and weft to weave a fabric with a warp's gray fabric density of 52.0/2.54 cm and a weft's gray fabric density of 53.5/2.54 cm.

A water jet loom was used as weaving machine, and a bar temple was provided between the beating-up portion and the friction roller to grip the fabric. No guide roll was installed between the whip roll and the heddle.

The weaving conditions included a warp tension during weaving of 180 cN/yarn, a top yarn tension during weaving machine downtime of 180 cN/yarn, a bottom yarn tension of 180 cN/yarn, and a weaving machine rotating speed of 500 rpm.

Then, an open soaper type scouring machine was scoured at a scouring tank temperature of 65° C. and a rinsing tank temperature of 40° C., followed by drying at 120° C. Subsequently, a pin tenter drier was used to heat-set the resulting fabric at 120° C. for one minute under the size control conditions of a width shrinkage rate of 0% and an overfeed rate of 0%.

Characteristics of the resulting air bag fabric are shown in Table 4. The resulting air bag fabric had an unexpectedly high edgecomb resistance to improve the seam slippage resistance. Furthermore, it was also low in air permeability and high in foldability.

Example 16

The nylon 66 fiber produced in Example 8 was used in an untwisted state as warp and weft to weave a fabric with a warp's gray fabric density of 48.0/2.54 cm and a weft's gray fabric density of 48.0/2.54 cm.

A water jet loom was used as weaving machine, and a bar temple was provided between the beating-up portion and the friction roller to grip the fabric. No guide roll was installed between the whip roll and the heddle.

The weaving conditions included a warp tension during weaving of 180 cN/yarn, a top yarn tension during weaving machine downtime of 180 cN/yarn, a bottom yarn tension of 180 cN/yarn, and a weaving machine rotating speed of 500 rpm.

Then, an open soaper type scouring machine was scoured at a scouring tank temperature of 65° C. and a rinsing tank temperature of 40° C., followed by drying at 120° C. Subsequently, a pin tenter drier was used to heat-set the resulting fabric at 120° C. for one minute under the size control conditions of a width shrinkage rate of 0% and an overfeed rate of 0%.

Characteristics of the resulting air bag fabric are shown in Table 4. The resulting air bag fabric had an unexpectedly high edgecomb resistance to improve the seam slippage resistance. Furthermore, it was also low in air permeability and high in foldability.

Example 17

The nylon 66 fiber produced in Example 2 was used in an untwisted state as warp and weft to weave a fabric with a warp's gray fabric density of 71.5/2.54 cm and a weft's gray fabric density of 71.5/2.54 cm.

A water jet loom was used as weaving machine, and a ring temple was provided between the beating-up portion and the friction roller to grip the fabric. No guide roll was installed between the whip roll and the heddle.

The weaving conditions included a warp tension during weaving of 80 cN/yarn, a top yarn tension during weaving machine downtime of 80 cN/yarn, a bottom yarn tension of 80 cN/yarn, and a weaving machine rotating speed of 500 rpm.

Then, an open soaper type scouring machine was scoured at a scouring tank temperature of 65° C. and a rinsing tank temperature of 40° C., followed by drying at 120° C. Subsequently, a pin tenter drier was used to heat-set the resulting fabric at 120° C. for one minute under the size control conditions of a width shrinkage rate of 0% and an overfeed rate of 0%.

Characteristics of the resulting air bag fabric are shown in Table 4. The resulting air bag fabric had an unexpectedly high edgecomb resistance to improve the seam slippage resistance. Furthermore, it was also low in air permeability and high in foldability.

TABLE 4

| | | Unit | Example 12 | Example 13 | Example 14 | Example 15 | Example 16 | Example 17 |
|---|---|---|---|---|---|---|---|---|
| Yarn characteristics | Warp's total fineness | dtex | 350 | 350 | 350 | 470 | 470 | 235 |
| | Warp's single fiber fineness (Mtw) | dtex | 1.82 | 1.82 | 1.82 | 1.22 | 1.22 | 1.72 |
| | Weft's total fineness | dtex | 350 | 350 | 350 | 470 | 470 | 235 |
| | Weft's single fiber fineness (Mtf) | dtex | 1.82 | 1.82 | 1.82 | 1.22 | 1.22 | 1.72 |
| Weaving conditions | Warp tension during weaving | cN/yarn | 150 | 150 | 150 | 180 | 180 | 80 |
| | Top yarn tension in warp shed/ bottom yarn tension in warp shed | cN/yarn | 120/169 | 120/169 | 150/150 | 180/180 | 180/180 | 80/80 |
| | Temple in use | | bar temple | bar temple | bar temple | bar temple | bar temple | ring temple |
| Grey characteristics | Warp's grey density | number/2.54 cm | 56.0 | 62.0 | 58.0 | 52.0 | 48.0 | 71.5 |
| | Weft's grey density | number/2.54 cm | 63.0 | 63.0 | 59.5 | 53.5 | 48.0 | 71.5 |
| Fabric characteristics | Fabric thickness | mm | 0.25 | 0.26 | 0.24 | 0.30 | 0.29 | 0.21 |
| | Warp's fabric density (Nw) | number/2.54 cm | 56.5 | 62.5 | 58.5 | 52.5 | 49.0 | 72.0 |
| | Weft's fabric density (Nf) | number/2.54 cm | 63.5 | 63.0 | 60.0 | 54.0 | 49.0 | 72.0 |
| | Warp's cover factor (CFw) | | 1003 | 1109 | 1038 | 1080 | 1008 | 1047 |
| | Weft's cover factor (CFf) | | 1127 | 1118 | 1065 | 1111 | 1008 | 1047 |
| | CFw + CFf | | 2130 | 2227 | 2103 | 2190 | 2016 | 2094 |
| | CFf − CFw | | 124 | 9 | 27 | 31 | 0 | 0 |
| | Fabric basis weight | $g/m^2$ | 171 | 186 | 172 | 207 | 192 | 140 |
| | Tensile strength (warp/weft) | N/cm | 616/653 | 651/675 | 625/643 | 758/771 | 674/735 | 525/548 |
| | Rupture elongation (warp/weft) | % | 27/22 | 30/23 | 30/25 | 32/25 | 33/26 | 30/26 |
| | Tear strength (warp/weft) | N | 150/141 | 138/146 | 149/145 | 195/201 | 193/204 | 106/108 |
| | Fabric's air permeability (AP) | $L/cm^2/min$ | 0.41 | 0.30 | 0.42 | 0.18 | 0.24 | 0.50 |
| | Packability | $cm^3$ | 1282 | 1580 | 1387 | 1859 | 1555 | 1054 |
| | Warp edgecomb resistance (ECw) | N | 577 | 817 | 509 | 622 | 522 | 666 |
| | Weft edgecomb resistance (ECf) | N | 638 | 856 | 505 | 522 | 387 | 693 |
| | ECw/Mtw | N/dtex | 317 | 449 | 280 | 508 | 426 | 387 |
| | ECf/Mtf | N/dtex | 350 | 470 | 277 | 426 | 316 | 403 |
| | AP × CF | $L/cm^2/min$ | 873 | 668 | 883 | 394 | 484 | 1047 |

Comparative Example 6

Except that the nylon 66 fiber produced in Reference Example 1 was used as warp and weft under the conditions shown in Table 5, the same procedure as in Example 12 was carried out to produce an air bag fabric.

Characteristics of the resulting air bag fabric are shown in Table 5. The resulting air bag fabric was inferior to the fabric produced in Example 12 in terms of seam slippage resistance, air permeability, and high foldability.

Comparative Example 7

Except that the nylon 66 fiber produced in Reference Example 2 was used as warp and weft, that a water jet loom was used as weaving machine, that a ring temple was provided between the beating-up portion and the friction roller to grip the fabric, that no guide roll was installed, and that the conditions shown in Table 5 were adopted, the same procedure as in Example 12 was carried out to produce an air bag fabric.

Characteristics of the resulting air bag fabric are shown in Table 5. The resulting air bag fabric was largely inferior to the fabric produced in Example 12 in terms of seam slippage resistance, air permeability, and high foldability.

Comparative Example 8

Except that the nylon 66 fiber produced in Reference Example 1 was used as warp and weft with a warp's gray fabric density of 62/2.54 cm and a weft's gray fabric density of 61.5/2.54 cm, the same procedure as in Example 13 was carried out to produce an air bag fabric.

Characteristics of the resulting air bag fabric are shown in Table 5. The resulting air bag fabric was inferior to the fabric produced in Example 13 in terms of edgecomb resistance, air permeability, and high foldability.

Comparative Example 9

Except that the nylon 66 fiber produced in Reference Example 2 was used as warp and weft with a warp's gray fabric density of 62.5/2.54 cm and a weft's gray fabric density of 62.5/2.54 cm, the same procedure as in Example 13 was carried out to produce an air bag fabric.

Characteristics of the resulting air bag fabric are shown in Table 5. The resulting air bag fabric was largely inferior to the fabric produced in Example 13 in terms of edgecomb resistance, air permeability, and high foldability.

Comparative Example 10

Except that the nylon 66 fiber produced in Reference Example 2 was used as warp and weft with a warp's gray fabric density of 58.5/2.54 cm and a weft's gray fabric density of 58.5/2.54 cm, the same procedure as in Example 14 was carried out to produce an air bag fabric.

Characteristics of the resulting air bag fabric are shown in Table 5. The resulting air bag fabric was largely inferior to the fabric produced in Example 14 in terms of edgecomb resistance, air permeability, and high foldability.

TABLE 5

| | | Unit | Comparative example 6 | Comparative example 7 | Comparative example 8 | Comparative example 9 | Comparative example 10 |
|---|---|---|---|---|---|---|---|
| Yarn characteristics | Warp's total fineness | dtex | 350 | 350 | 350 | 350 | 350 |
| | Warp's single fiber fineness (Mtw) | dtex | 2.6 | 4.9 | 2.6 | 4.9 | 4.9 |
| | Weft's total fineness | dtex | 350 | 350 | 350 | 350 | 350 |
| | Weft's single fiber fineness (Mtf) | dtex | 2.6 | 4.9 | 2.6 | 4.9 | 4.9 |
| Weaving conditions | Warp tension during weaving | cN/yarn | 147 | 69 | 150 | 150 | 150 |
| | Top yarn tension in warp shed/ bottom yarn tension in warp shed | cN/yarn | 118/167 | 69/69 | 150/150 | 150/150 | 150/150 |
| | Temple in use | | bar temple | ring temple | bar temple | bar temple | bar temple |
| Grey characteristics | Warp's grey density | number/2.54 cm | 56.0 | 56.0 | 62.0 | 62.5 | 58.5 |
| | Weft's grey density | number/2.54 cm | 63.0 | 63.0 | 61.5 | 62.5 | 58.5 |
| Fabric characteristics | Fabric thickness | mm | 0.24 | 0.25 | 0.26 | 0.27 | 0.24 |
| | Warp's fabric density (Nw) | number/2.54 cm | 56.0 | 54.0 | 62.5 | 63.0 | 59.0 |
| | Weft's fabric density (Nf) | number/2.54 cm | 64.0 | 61.0 | 62.0 | 63.0 | 59.0 |
| | Warp's cover factor (CFw) | | 994 | 958 | 1109 | 1118 | 1047 |
| | Weft's cover factor (CFf) | | 1136 | 1083 | 1100 | 1118 | 1047 |
| | CFw + CFf | | 2130 | 2041 | 2210 | 2236 | 2094 |
| | CFf − CFw | | 142 | 124 | −9 | 0 | 0 |
| | Fabric basis weight | $g/m^2$ | 171 | 166 | 182 | 191 | 170 |
| | Tensile strength (warp/weft) | N/cm | 591/678 | 569/633 | 661/669 | 659/671 | 621/645 |
| | Rupture elongation (warp/weft) | % | 30/24 | 29/26 | 29/24 | 29/25 | 32/26 |
| | Tear strength (warp/weft) | N | 158/155 | 170/174 | 145/151 | 162/170 | 162/159 |
| | Fabric's air permeability (AP) | $L/cm^2/min$ | 0.55 | 1.61 | 0.65 | 1.2 | 1.02 |
| | Packability | $cm^3$ | 1470 | 1860 | 1760 | 2010 | 1688 |
| | Warp edgecomb resistance (ECw) | N | 446 | 345 | 712 | 650 | 334 |
| | Weft edgecomb resistance (ECf) | N | 471 | 379 | 673 | 632 | 282 |
| | ECw/Mtw | N/dtex | 172 | 70 | 274 | 133 | 68 |
| | ECf/Mtf | N/dtex | 181 | 77 | 259 | 129 | 58 |
| | AP × CF | $L/cm^2/min$ | 1171 | 3286 | 1436 | 2684 | 2136 |

Comparative Example 11

Except that the nylon 66 fiber produced in Reference Example 3 was used as warp and weft with a warp's gray fabric density of 52.0/2.54 cm and a weft's gray fabric density of 52.5/2.54 cm, the same procedure as in Example 15 was carried out to produce an air bag fabric.

Characteristics of the resulting air bag fabric are shown in Table 6. The resulting air bag fabric was largely inferior to the fabric produced in Example 15 in terms of edgecomb resistance, air permeability, and high foldability.

Comparative Example 12

Except that the nylon 66 fiber produced in Reference Example 3 was used as warp and weft, the same procedure as in Example 16 was carried out to produce an air bag fabric.

Characteristics of the resulting air bag fabric are shown in Table 6. The resulting air bag fabric was largely inferior to the fabric produced in Example 16 in terms of edgecomb resistance, air permeability, and high foldability.

Comparative Example 13

Except that the nylon 66 fiber produced in Reference Example 4 was used as warp and weft, the same procedure as in Example 17 was carried out to produce an air bag fabric.

Characteristics of the resulting air bag fabric are shown in Table 6. The resulting air bag fabric was largely inferior to the fabric produced in Example 17 in terms of edgecomb resistance, air permeability, and high foldability.

Comparative Example 14

Except that the nylon 66 fiber produced in Reference Example 5 was used as warp and weft, the same procedure as in Example 17 was carried out to produce an air bag fabric.

Characteristics of the resulting air bag fabric are shown in Table 6. The resulting air bag fabric was largely inferior to the fabric produced in Example 17 in terms of edgecomb resistance, air permeability, and high foldability.

TABLE 6

| | | Unit | Comparative example 11 | Comparative example 12 | Comparative example 13 | Comparative example 14 |
|---|---|---|---|---|---|---|
| Yarn characteristics | Warp's total fineness | dtex | 470 | 470 | 235 | 235 |
| | Warp's single fiber fineness (Mtw) | dtex | 3.46 | 3.46 | 3.26 | 6.53 |
| | Weft's total fineness | dtex | 470 | 470 | 235 | 235 |
| | Weft's single fiber fineness (Mtf) | dtex | 3.46 | 3.46 | 3.26 | 6.53 |
| Weaving conditions | Warp tension during weaving | cN/yarn | 180 | 180 | 80 | 80 |
| | Top yarn tension in warp shed/ bottom yarn tension in warp shed | cN/yarn | 180/180 | 180/180 | 80/80 | 80/80 |
| | Temple in use | | bar temple | bar temple | ring temple | ring temple |
| Grey characteristics | Warp's grey density | number/2.54 cm | 52 | 48 | 71.5 | 71.5 |
| | Weft's grey density | number/2.54 cm | 52.5 | 48 | 71.5 | 71.5 |
| Fabric characteristics | Fabric thickness | mm | 0.31 | 0.3 | 0.21 | 0.21 |
| | Warp's fabric density (Nw) | number/2.54 cm | 52.5 | 49 | 72 | 72 |

TABLE 6-continued

| | Unit | Comparative example 11 | Comparative example 12 | Comparative example 13 | Comparative example 14 |
|---|---|---|---|---|---|
| Weft's fabric density (Nf) | number/2.54 cm | 53 | 49 | 72 | 72 |
| Warp's cover factor (CFw) | | 1080 | 1008 | 1047 | 1047 |
| Weft's cover factor (CFf) | | 1090 | 1008 | 1047 | 1047 |
| CFw + CFf | | 2170 | 2016 | 2094 | 2094 |
| CFf − CFw | | 10 | 0 | 0 | 0 |
| Fabric basis weight | $g/m^2$ | 206 | 192 | 141 | 139 |
| Tensile strength (warp/weft) | N/cm | 738/766 | 669/721 | 530/533 | 532/545 |
| Rupture elongation (warp/weft) | % | 32/25 | 31/25 | 30/25 | 30/25 |
| Tear strength (warp/weft) | N | 209/213 | 221/222 | 112/115 | 124/123 |
| Fabric's air permeability (AP) | $L/cm^2/min$ | 0.68 | 0.78 | 1.31 | 2.02 |
| Packability | $cm^3$ | 2010 | 1800 | 1189 | 1245 |
| Warp edgecomb resistance (ECw) | N | 560 | 451 | 566 | 438 |
| Weft edgecomb resistance (ECf) | N | 457 | 386 | 551 | 421 |
| ECw/Mtw | N/dtex | 162 | 130 | 174 | 67 |
| ECf/Mtf | N/dtex | 132 | 112 | 169 | 64 |
| AP × CF | $L/cm^2/min$ | 1475 | 1572 | 2743 | 4230 |

INDUSTRIAL APPLICABILITY

The air bag fabric comprises high strength yarns for air bags with a low single fiber fineness that have been unavailable conventionally, has a largely improved edgecomb resistance required for air bags fabrics, and also has a decreased air permeability and an increased foldability. Accordingly, the air bag fabric serves effectively for various uses including, but not limited to, air bags for driver seat, passenger seats, and side walls.

The invention claimed is:

1. An air bag fabric comprising a warp and a weft each comprising polyamide multifilaments with a total fineness of 200 to 700 dtex and a single fiber fineness of 1 to 2 dtex and having a cover factor (CF) of 1,800 to 2,300, wherein a ratio ECw/Mtw between edgecomb resistance, ECw, and single fiber fineness, Mtw, in the warp direction, and a ratio ECf/Mtf between edgecomb resistance, ECf, and single fiber fineness, Mtf, in the weft direction are both in a range of 250 to 1,000 N/dtex.

2. The air bag fabric as claimed in claim 1, wherein the edgecomb resistance is 500 to 1,000 N in both the warp direction and the weft direction.

3. The air bag fabric as claimed in claim 1, wherein air permeation (AP) as measured at a test pressure difference of 19.6 kPa is 0.5 $L/cm^2/min$ or less.

4. The air bag fabric as claimed in claim 1, wherein the product AP×CF of air permeation AP ($L/cm^2/min$) and the cover factor CF of the fabric is 1,100 $L/cm^2/min$ or less.

5. The air bag fabric as claimed in claim 1, wherein the warp has a cover factor CFw that is smaller by 50 to 200 than the cover factor CFf of the weft.

6. The air bag fabric as claimed in claim 1, wherein packability is 1,500 or less.

7. A yarn for air bags comprising polyamide multifilament with a total fineness of 200 to 700 dtex, a single fiber fineness of 1 to 2 dtex, strength of 7 to 10 cN/dtex, and elongation of 20 to 30% said airbags having a cover factor (CF) of 1,800 to 2,300, and wherein a ratio ECw/Mtw between edgecomb resistance, ECw, and single fiber fineness, Mtw, in the warp direction, and a ratio ECf/Mtf between edgecomb resistance, ECf, and single fiber fineness, Mtf, in the weft direction are both in a range of 250 to 1,000 N/dtex.

8. The yarn as claimed in claim 7 wherein the polyamide is polyhexamethylene adipamide with a sulfuric acid relative viscosity of 3 to 4.

9. The yarn as claimed in claim 7, wherein fineness unevenness is 0.5 to 1.5%.

10. A method for producing the yarn as claimed in claim 7, wherein polyamide is melt-spun, cooled with a circular cooling equipment, and then stretched.

11. The method as claimed in claim 10, wherein fiber extruded from a spinning orifice after being melt-spun is supplied with steam and then passed through a slow cooling cylinder.

12. The method claimed in claim 11, wherein the slow cooling cylinder has a length of 30 to 150 trim and the circular cooling equipment has a cooling air blowout length of 600 to 1,200 mm.

13. The method of claim 10, wherein the difference between internal pressure in the cooling cylinder of the circular cooling equipment and atmospheric pressure is 500 to 1200 Pa.

14. The method of claim 10, wherein air speed cooling air is nonuniform along a length direction of the circular cooling equipment, upper side air speed $V_U$ being smaller than lower side air speed $V_L$, and values of $V_L/V_U$, $V_U$, and $V_L$ being 2 to 3, 10 to 30 m/min, and 40 to 80 m/min, respectively.

15. The method of claim 11, wherein steam blowout pressure is 100 to 600 Pa.

* * * * *